United States Patent [19]

Fee

[11] Patent Number: 4,844,337

[45] Date of Patent: Jul. 4, 1989

[54] RAILWAY RAIL ASSEMBLY

[75] Inventor: Graham M. Fee, Geneva, Ohio

[73] Assignee: Chemetron-Railway Products, Inc., Wheeling, Ill.

[21] Appl. No.: 32,145

[22] Filed: Mar. 27, 1987

[51] Int. Cl.[4] ..... E01B 9/30

[52] U.S. Cl. ..... 238/21; 238/338; 238/349

[58] Field of Search ..... 238/17, 18, 21, 22, 238/217, 310, 315, 323, 338, 341, 343, 349, 351–354, 378

[56] References Cited

U.S. PATENT DOCUMENTS

| | | | |
|---|---|---|---|
| 2,570,871 | 10/1951 | Schulze | 238/323 |
| 4,442,973 | 4/1984 | Fee | 238/349 |
| 4,452,392 | 6/1984 | Rajaram et al. | 238/349 |
| 4,461,422 | 7/1984 | Harkus | 238/349 |
| 4,489,885 | 12/1984 | Bryan | 238/349 |
| 4,625,912 | 12/1986 | Fee | 238/349 |

FOREIGN PATENT DOCUMENTS

| | | | |
|---|---|---|---|
| 998625 | 2/1983 | U.S.S.R. | 238/17 |

*Primary Examiner*—Sherman D. Basinger
*Assistant Examiner*—Stephen P. Avila
*Attorney, Agent, or Firm*—Welsh & Katz, Ltd.

[57] ABSTRACT

A main railway rail and a guard rail are maintained in spaced apart relationship on a tie plate having a shoulder located between the rails by an elastically deformed clip. The clip has two end lengths extending from opposite ends of a central length. One length of the clip rides on the main rail flange and the other length of the clip rides on the guard rail flange while the central length engages the intermediate shoulder.

6 Claims, 1 Drawing Sheet

80 in place. The shoulder 52 thus forces the central leg 82 downwardly and the end length 84 upwardly which elastically deforms the clip 80. The inner clip 80 thus urges the rails 10 and 20 against the outer shoulders 36 and 46 respectively to maintain the 2" spaced relationship.

Tests upon the assembly shown and described above were conducted in accordance with AREA specifications 1.9.1.11, 0.12 and 0.13 to determine its longitudinal restraint and lateral load capabilities using 100 pound ARA B rails. The assembly easily met all of the AREA specifications and transit authority requirements.

While a present preferred embodiment of the invention has been shown and described, it is to be distinctly understood that the invention is not limited thereto but may be otherwise variously embodied within the scope of the following claims.

What is claimed is:

1. In a rail assembly including a tie plate adapted to be secured to a tie, and a main railway rail and a guard rail each having a base flange and a rail head and being supported on said tie plate so that said rail heads are in relatively closely spaced relation and said base flanges define outwardly directed and mutually facing inwardly directed rail flanges; the combination therewith comprising stop means cooperative with the tie plate so as to abut said outwardly directed rail flanges and limit the spaced apart relation of the corresponding rail heads, a generally upstandnng shoulder fixed to said tie plate between said mutually facing rail flanges and defining a hook having a generally downwardly facing concave surface disposed opposite one of said rails, and an elastically deformable S-shaped drive-on clip having a central length portion and laterally spaced end lengths each of which extends from an opposite end of said central length, said end lengths being spaced apart a distance greater than the distance between said rail heads and being generally parallel to said central length and configured to enable insertion of said clip between the spaced rail heads when in a first orientation whereafter said clip may be manipulated to a second orientation to place said central length substantially parallel to an axis of curvature of said concave surface and facilitate releasable mounting of said clip on said shoulder with said central length driven lengthwise into and captured by said hook so as to cause said end lengths to each forcibly bear against a corresponding one of said mutually facing base flanges and urge said rails to spaced apart positions wherein said outwardly directed flanges abut said stop means.

2. A rail assembly as defined in claim 1 wherein said end lengths of said S-shaped clip are formed integral with said central length and extend generally alongside and parallel to said central length, said S-shaped clip and said shoulder being configured to effect torsional compression of each of said end lengths against a corresponding one of said inclined upper flange surfaces when said central length of said clip is captured by said hook.

3. A rail assembly as defined in claim 2 wherein said clip in its relaxed state is configured such that said end lengths define longitudinal axes lying in a common plane, said central length having a longitudinal axis spaced from said common plane, said shoulder being configured to torsionally force said central length toward said common plane when said central length of said clip is engaged with said hook and said end lengths engage said mutually facing inclined upper flange surfaces.

4. A railway rail assembly comprising, in combination, a tie plate, a main railway rail having a head and a base flange engaging said tie plate, a guard rail having a head and a base flange engaging said tie plate and being substantially parallel to said main railway rail, said flanges of said railway and guard rails defining outer and inner flange portions with said inner flange portions having mutually facing downwardly inclined upper surfaces, a pair of outer shoulders cooperative with said tie plate for abutment with said outer flange portions so as to establish a predetermined relatively closely spaced relation between the corresponding rail heads, a pair of first elastically deformable retaining clips releasably mountable on said outer shoulders for engagement with the corresponding outer flange portions to retain said outer flange portions against said tie plate, an inner shoulder disposed on said tie plate between said inner flange portions of said rails and defining a hook generally facing one of said downwardly inclined flange surfaces, and a second elastically deformable S-shaped retaining clip having a central length and laterally spaced end lengths each of which extends from an opposite end of said central length in substantially parallel relation with said central length, said second retaining clip being configured to enable insertion between said rail heads when in a first orientation whereafter said clip may be reoriented to enable releasable mounting on said inner shoulder with said central length driven lengthwise into and captured by said hook and with said end lengths forcefully bearing against said mutually facing upper inclined flange surfaces so as to retain said rails in fixed spaced relation on said tie plate.

5. In a guard rail assembly including a tie plate adapted to be secured to be secured to a tie, and a main railway rail and a guard rail each having a rail head and a base flange and being supported on said tie plate so that said heads are in relatively closely spaced relation; the combination therewith comprising stop means cooperative with said tie plate and outwardly directed rail flanges so as to limit the spaced apart relation between said rail heads, an upstanding shoulder fixed to said tie plate between said rails and defining a hook having a generally downwardly facing concave surface disposed opposite one of said rails, and an elastically deformable generally S-shaped clip having a central length portion and laterally spaced end lengths each of which extends from an opposite end of said central length portion, said S-shaped clip being configured to enable insertion between said rail heads and orientation to facilitate releasable mounting of said clip on said shoulder with said central length portion driven longitudinally into and captured by said hook so as to cause said end lengths to each forcibly bear against a corresponding base flange, said shoulder defining an inclined entry surface adjacent said concave hook surface to guide said central length into said hook upon mounting said clip on said shoulder.

6. A rail assembly including a tie plate adapted to be secured to a tie, and a main railway rail and a guard rail each having a rail head and a base flange and being supported on said tie plate so that said heads are in relatively closely spaced relation; the combination therewith comprising stop means cooperative with said tie plate and outwardly directed rail flanges so as to limit the spaced apart relation between said rail heads, an upstanding shoulder fixed to said tie plate between said rails and defining a hook having a generally down-

RAILWAY RAIL ASSEMBLY

The present invention relates to a means for maintaining a main running railway rail and a guard rail in spaced relationship.

Running and guard rails are maintained at about a 2 inch spacing as measured between the sides of their heads. The current practice in the rail industry for maintaining this spacing is to bolt spacers to the webs of the rails before anchoring the outside base flanges of the bolted rails onto a tie plate with elastic type clips, spikes and the like. Thus, the rail webs must first be drilled and then bolted together before fastening the assembly to the ties. Rail changes require even more of these steps as the worn rail must be disassembled and the new rail installed in its place. Thus, the current practice in the industry involves a considerable amount of very tedious labor and much handling of the bolts, nuts and lockwashers required to assemble the rails as a unit.

The present invention provides a main rail and a guard rail maintained in spaced relationship on a tie plate having a shoulder disposed between the rails utilizing an elastically deformed clip. The elastic clip has two end lengths extending from opposite ends of a central length with one end length urging against the main rail and the other end length urging against the guard rail when the central length engages the shoulder. Preferably, the elastic clip has an "S" configuration like the type of S-clip heretofore sold under the trademark "Lineloc" by True Temper Railway Appliances, Inc. of Lake City, Pennsylvania for fastening single rails to tie plates. The rails and clips can be quickly and easily installed and disassembled with considerably less effort and handling than has been required heretofore In addition, the rails do not substantially move laterally (or otherwise) even though both ends of the clip are merely riding on the rail flanges and not fastened to the webs. The present invention easily meets the current AREA specifications and transit authority requirements.

Other details, objects and advantages of the invention will become apparent as the following description of a present preferred embodiment thereto proceeds.

In the accompanying drawings, a present preferred embodiment of the invention is shown in which.

Figure 2:
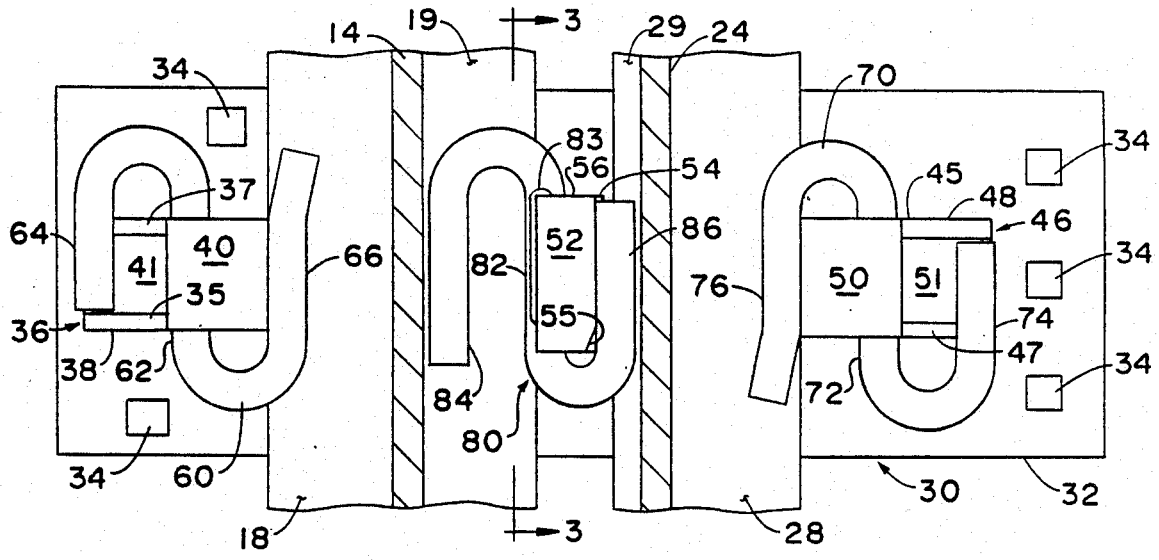
FIG. 2 is a plan sectional view of the embodiment of FIG. 1 taken along section line 2—2.

The figures generally show a main rail 10 on which railway wheels run and an adjacent guard rail 20 disposed on a tie plate 30. The main rail 10 generally comprises a head 12 on a web 14 vertically extending above the upper surfaces 18 and 19 of a base flange 16 which slopes downwardly from the web. Similarly, the guard rail 20 has a head 22 on a web 24 which vertically extends above the upper surfaces 28 and 29 of a base flange 26. The term "inner" as hereinafter used in this description refers to structure of the assembly which is located in the area between the centerlines of the rails 10 and 20 and the term "outer" refers to structure which is located outside of that area (unless the context clearly indicates otherwise). The distance between the adjacent sides of the heads 12 and 22 is about 2 inches according to AREA specifications and transit authority requirements. This requires that the guard rail flange 26 must be truncated on its inner side as shown.

Figure 1:
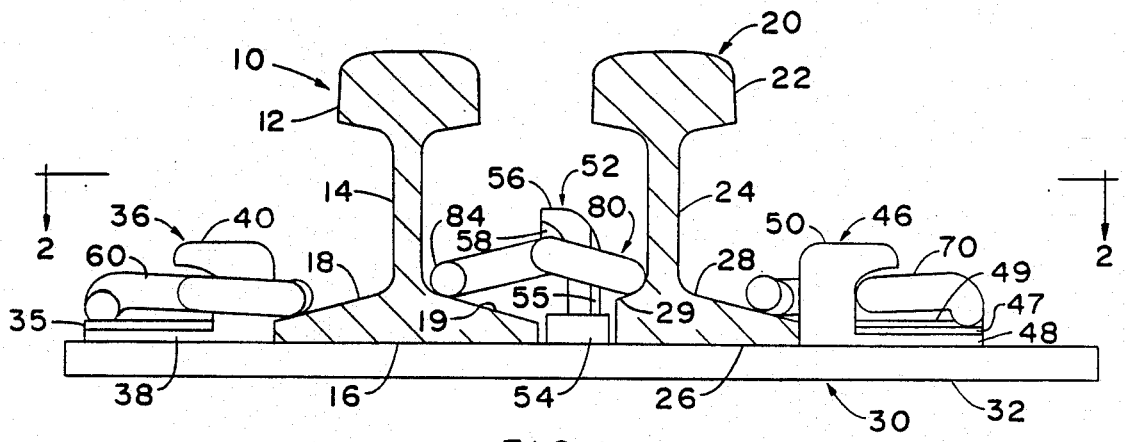
FIG. 1 is a front elevation of the present preferred embodiment.
Figure 3:
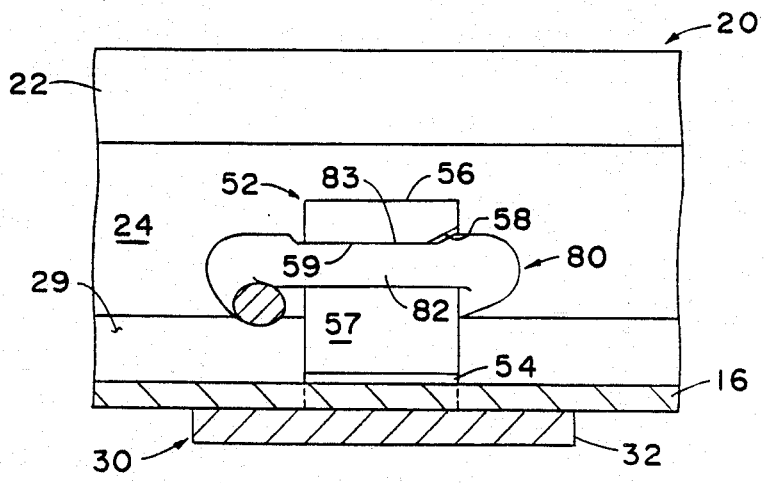
FIG. 3 is a side sectional view of the embodiment of FIG. 1 taken along section line 3—3 on FIG. 2.

The tie plate 30 comprises a horizontal base plate 32 having holes 34 for receiving spikes or fasteners (not shown) which fasten the tie plate 30 into an underlying wood or concrete tie (also not shown). The base plate 32 may be constructed from mild steel or other suitable material. Outer shoulders 36 an 46 are fastened to the base plate, preferably by welding. Shoulders having descending anchor members or other suitable means also may be utilized. Also, they may be cast steel or other suitable material. The illustrated outer shoulders 36 and 46 have bases 38 and 48 which define stop means abutting the outer flanges 16 and 26 of the rails 10 and 20, respectively. Upstanding hooks 40 and 50 extend above lands 41 and 51 of the shoulder bases 38 and 48 respectively for elastically receiving clips 60 and 70 respectively. Land 41 is disposed between ramps 35 and 37 with a generally vertical surface (not shown) rising from the land to the top of ramp 35 for locking the deformed clip 60 in place. Similarly, land 51 is disposed between ramps 45 and 47 with surface 49 disposed between the land 51 and the ramp 45 for locking the deformed clip 70 in place. The FIGS. 1 and 2 illustrate S-clips sold by True Temper Railway Appliances, Inc. which may be hammered into engagement, or driven by hydraulic machine, onto the shoulders 36 and 46. Other drive-on clips or spring-on clips may also be used. The illustrated clips 60 and 70 have central lengths 62 and 72 respectively engaged with the hooks 40 and 50 causing end lengths 64 and 74 extending from one end of their central lengths 62 and 72 to exert a downward force on the respective lands 41 and 51 while end lengths 66 and 76 extending from the opposite end of th central lengths 62 and 72 exert a downward force on the upper surfaces 18 and 28 of the main rail flange 16 and the guard rail flange 26. Although not shown, any of many known electric insulators may be placed between the end lengths 66 and 76 of the S-clips 60 and 70 and the rail flange surfaces 18 and 28.

The tie plate 30 has an inner shoulder 52 welded or otherwise suitably fastened to the base plate 32 between the rails 10 and 20. The inner shoulder 52 has a base 54 which supports an upstanding hook 56 having a downwardly facing concave surface 57 with an inclined entry portion 58 and following detent portion 59 for receiving the central length 82 of an inner clip 80 which is preferably of an "S" configuration having the central length 82 generally disposed above the plane defined by its end lengths. The illustrated inner clip 80 has an end length 84 extending from one end of the central length 82 onto the main rail flange upper surface 19 and another end length 86 extending from the opposite end of the central length 82 onto the guard rail flange upper surface 29. The illustrated inner clip 80 is installed by placing the end lengths 84 and 86 on the rail flange upper surfaces 19 and 29 with the leading portion of the inner clip 80 aligned with the entry portion 58 of the inner hook 56 and the end length 86 before surface 55, and then driving the rear portion of the clip 80 to drive the central length into the hook 56 and against the main portion of the concave surface 57. As the clip 80 is driven onto the entry portion 58, the advancing end 86 tends to rotate counterclockwise about the central length 82 but is maintained in proper engagement with the shoulder 52 by surface 55. The clip 80 is then driven until the detent portion 59 fully engages a slot 83 on the upper surface of the central length 82, which mechanically locks the clip wardly facing concave surface disposed opposite one of said rails, and an elastically deformable generally S-shaped clip having a central length portion and laterally spaced end lengths each of which extends from an opposite end of said central length portion, said S-shaped clip being configured to enable insertion between said rail heads and orientation to facilitate releasable mounting of said clip on said shoulder with said central length portion driven longitudinally into and captured by said hook so as to cause said end lengths to each forcibly bear against a corresponding base flange, said shoulder defining a detent surface, and said central length of said clip having a locking surface formed thereon cooperative with said detent surface to releasably lock said clip in mounted relation on said shoulder.

* * * * *